United States Patent [19]

Wilson

[11] 4,450,322

[45] May 22, 1984

[54] ADJUSTABLE SPEAKER SYSTEM AND METHOD OF ADJUSTMENT

[76] Inventor: David A. Wilson, 147 San Felipe Way, Novato, Calif. 94947

[21] Appl. No.: 317,053

[22] Filed: Nov. 2, 1981

[51] Int. Cl.[3] ..... H04R 1/28; H04R 1/02

[52] U.S. Cl. ..... 179/146 E; 179/146 R; 179/147; 181/147; 455/350

[58] Field of Search ..... 179/1 E, 1 GA, 1 AT, 179/146 E, 180, 147, 188, 146 R; 181/143, 147; 312/7.1, 7.2; 381/88; 455/350

[56] References Cited

U.S. PATENT DOCUMENTS

| | | | |
|---|---|---|---|
| 2,217,279 | 10/1940 | Karns . | |
| 2,808,121 | 10/1957 | Goettner . | |
| 2,927,657 | 3/1960 | Patla et al. . | |
| 3,105,569 | 10/1963 | Evans . | |
| 3,385,929 | 5/1968 | Magyar et al. . | |
| 3,666,041 | 5/1972 | Engelhardt . | |
| 3,824,343 | 7/1974 | Dahlquist . | |
| 3,927,261 | 12/1975 | Dahlquist . | |
| 3,953,675 | 4/1976 | Babb | 179/1 E |
| 3,976,162 | 8/1976 | Cummings . | |
| 3,983,337 | 9/1976 | Babb | 179/180 X |
| 4,139,734 | 2/1979 | Fincham | 179/1 E |
| 4,218,583 | 8/1980 | Poulo . | |
| 4,256,922 | 3/1981 | Görike . | |

*Primary Examiner*—A. D. Pellinen
*Assistant Examiner*—Danita R. Byrd
*Attorney, Agent, or Firm*—Fitch, Even, Tabin & Flannery

[57] ABSTRACT

A speaker assembly and its method of operation are described wherein a plurality of drivers are spatially adjustable relative to each other and to a selected critical listening point in order to establish maximum sound coherency for the system. Means for adjustment and calibration of the relative positions of the drivers are provided to facilitate their location upon a mounting sub-assembly, interchange of components within the total speaker assembly, and synchronization of the drivers for one or more desired listening positions within a listening environment. The speaker system preferably includes a low frequency range sub-assembly having one or more drivers supported in fixed relation within the total speaker system, a housing for the low frequency range sub-assembly including selective band-pass energy filtration means for isolating each driver from its enclosure and an internal structure providing increased structural rigidity and reducing non-linear turbulence within the enclosure.

12 Claims, 9 Drawing Figures

ADJUSTABLE SPEAKER SYSTEM AND METHOD OF ADJUSTMENT

BACKGROUND OF THE INVENTION

The present invention relates to improvements in loudspeaker accuracy in the field of high fidelity sound reproduction and more particularly to a method and apparatus for achieving such improvements.

The prior art has long been concerned with apparatus and methods of operation for speaker systems in order to accurately reproduce various sounds from an electronic input.

It has been thought by many that the ideal speaker would be a point-source from which all the frequencies being reproduced would emanate. Limitations of technology have prevented the construction of such a driver. In attempting to achieve sufficient acoustical output across the entire audible frequency band, the prior art has generally resorted to the use of a plurality of drivers of differing construction, each type reproducing a specific portion of the frequencies within that band. Moreover, it has been generally recognized that linear reproduction of the audible frequency range is important to achieve realism in the reproduced sound.

More recently, the importance of polarity and phase alignment of the drivers within the system, relative to each other, has been recognized. U.S. Pat. No. 3,824,343 issued July 16, 1974 to Dahlquist identifies and deals with the problem of "time delay distortion" as a barrier to "coherent sound" in multiple driver systems. Dalquist observes that, in a multiple driver system where all drivers are mounted in the same mechanical plane, the leading edge of a single pulse (an electrical test signal which most meaningfully simulates a short duration musical transient) applied to the system input will be reproduced acoustically by the system as a series of pulses that will appear to the listener as a distorted form of the original pulse. This "time delay distortion" has a number of causes. Initially, a lower mass driver-diaphragm, such as a tweeter dome, can be expected to reach more quickly to the pulse than the more massive woofer cone, so its portion of the pulse will arrive at the listener's ear before that of the woofer. In addition, the various elements in a crossover network may effect a group delay on portions of the input signal's spectrum. Thus, while the total energy output of a time delay distorted system may be identical with that of the applied signal, the waveform generated by the system may be substantially different.

In order to compensate for the differing "rise time" of each type of driver, defined as the inherent time lag between impression of a voltage and driver response, Dahlquist contemplated a fixed relative arrangement of the drivers so that the pulse wave form front contribution from each driver would be theoretically synchronized and would reach the ear of the listener at the same time. For this purpose, the higher range speakers were located somewhat further away from the listener than the lower range speakers.

However, because significant distances existed between the drivers of the above system while the location of the drivers relative to each other within the system were fixed, the proper pulse-arrival time alignment of the above system has been found in the present invention to be not only dependent upon freedom of arrangement for the speaker system within a selected listening environment, but more particularly, upon the location of the listening point relative to the speaker system. Speaker systems of the type contemplated by the present invention may be used in many different types of environments including, for example, studios or homes. In many such environments, there exist certain constraints which limit freedom of location for the speaker system. At the same time, a listener, particularly one with a discerning ear, desires to establish the speaker system so that maximum sound coherence is achieved at a predetermined critical listening point. Location of the critical listening point may or may not be determined by choice.

Accordingly, the predetermined relation of components within a speaker system of the type referred to above may not be adaptable to a given listening environment. The result may be a need for compromise between arrangement of the speaker system within the listening environment and the quality of sound reproduced by the system.

There has thus been found to remain a need for a method and apparatus in a speaker system for achieving maximum sound coherency for a plurality of drivers of a speaker system relative to a critical listening point of a selected listening environment while allowing the location of the speaker system and the critical listening point to be dictated at least in part by considerations imposed, for example, by the environment itself and/or by the listener.

SUMMARY OF THE INVENTION

It is an object of the present invention to provide a speaker assembly which may be adapted to a listening environment in order to produce highly coherent sound at a selected critical listening point in the environment. It is also an object of the invention to provide a method for adjusting such a speaker assembly in order to achieve this same purpose.

Generally, the present invention contemplates a speaker assembly including a plurality of sub-assemblies, each including single or multiple drivers, the various sub-assemblies covering the same or different frequency ranges, and being adapted to produce highly coherent sound at a critical listening point in a selected listening environment. Within the speaker assembly of the invention, selected drivers within the system are adjustable relative to the critical listening point. The adjusting means include calibration means for determining the relative positions of the drivers, for example on a mounting sub-assembly, when adjusted for pulse-arrival time alignment at a critical listening point.

Similarly, the invention contemplates a method for mounting or adjusting a plurality of drivers in a speaker assembly, the speaker assembly being arranged in a predetermined locale of a listening environment which also has a selected critical listening point. According to the method of the present invention, the drivers are independently supported with at least a portion of the drivers being adjustable relative to the critical point. A microphone and/or listener is then placed at the critical listening point as a monitor in order to adjust the respective drivers for maximum sound coherency of the system at that point.

The method and apparatus of the present invention also permit a number of additional features. For example, drivers adapted for interchangeability within the system will have calibrated positions which permit their interchange while maintaining substantial sound coherency at the critical listening point according to a calibration "correction factor".

In other words, the calibration correction factor may be engineered to compensate for the time delay differences between the interchanged drivers and allow the system to correctly maintain sound coherency at the critical listening point.

Furthermore, the invention contemplates construction of a housing, particularly for one or more low frequency range drivers, the housing including sound absorptive means for isolating the driver or drivers from the main part of the housing and an internal structure with sound wells behind the driver(s) in order to substantially increase the rigidity of the housing and to reduce turbulence, or non-linear movement of air, within the housing.

Additional objects and advantages of the invention are made apparent in the following description, having reference to the accompanying drawings.

DESCRIPTION OF THE PREFERRED EMBODIMENT

Figure 1:
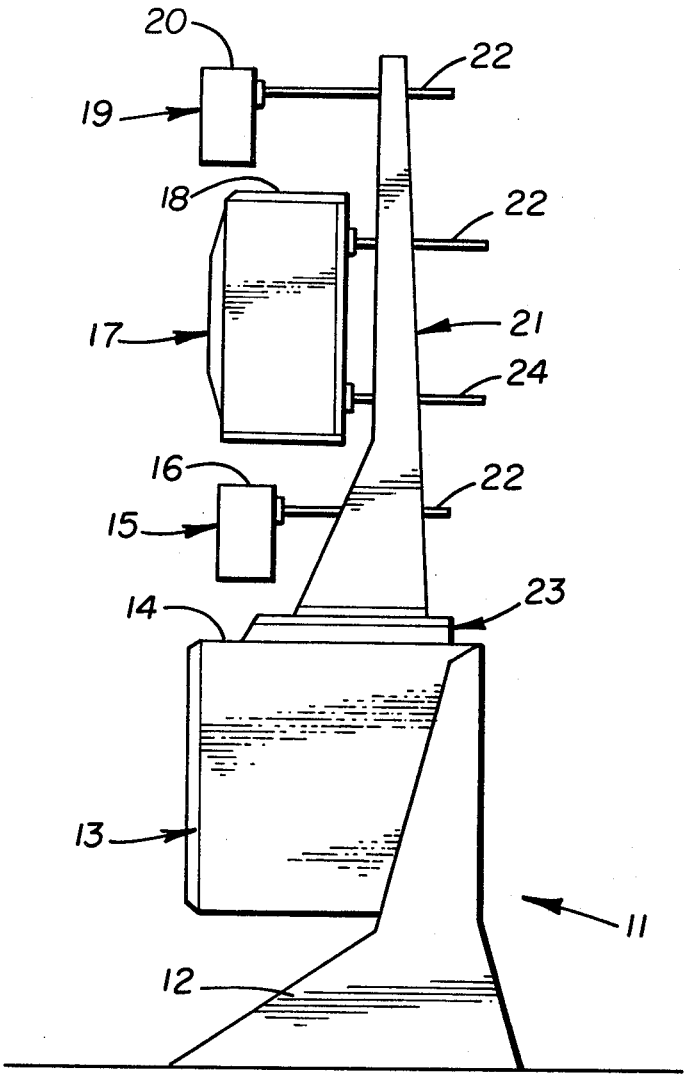
FIG. 1 is a side view in elevation of a speaker assembly constructed in accordance with the present invention.

A speaker system constructed in accordance with the present invention is generally indicated at 11 in FIG. 1. Preferably, the invention contemplates a speaker assembly including a relatively large number of drivers, or multiple driver sub-components, covering different frequency ranges in order to provide various desired characteristics such as accurate tonal balance, transient response, and power handling. However, for purposes of simplicity, it is believed that the present invention may be clearly understood from the simplified representation for the speaker assembly 11 which is illustrated in FIG. 1 as including a single low frequency range driver, or woofer, unit 13, two midrange units indicated at 15 and 19, and a single tweeter unit 17.

The drivers are illustrated as being supported by two mounting sub-assemblies generally indicated at 12 and 21.

The woofer unit 13 is preferably mounted upon, and in fixed relation to the support base 12. The upper mounting subassembly 21 rests upon an adjustable support 23, and extends upward from the woofer unit 13 to provide support for the other driver units 15, 19, and 17.

Since the construction of the drivers is generally conventional, with the exception of the woofer housing 14, it is not believed necessary to show components of the driver units 15, 19, and 17 in greater detail.

The speaker assembly 11 of the present invention is particularly adapted for adjusting the various drivers generally fore and aft relative to a critical listening point in a listening environment in order to establish maximum sound coherency for the system at that point.

Figure 2:
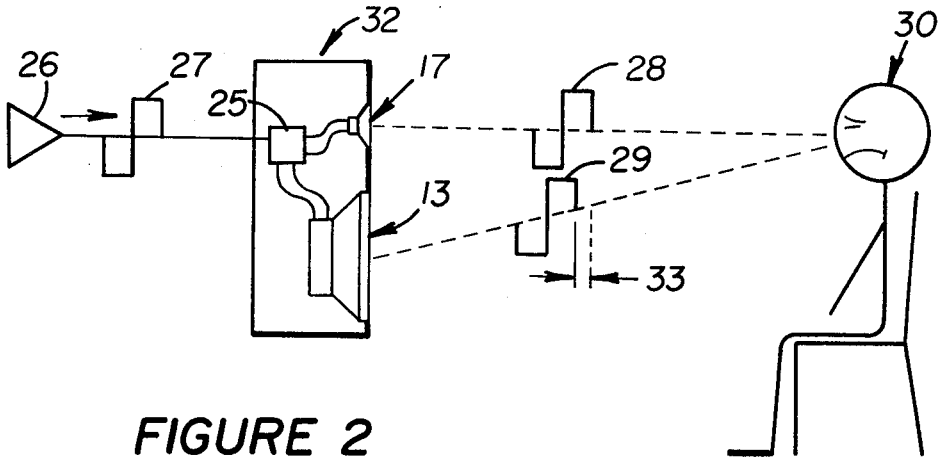
FIG. 2 illustrates a simplified schematic representation of a speaker system with a coplanar arrangement of its drivers in a manner common in the prior art as described above, where sound wavefront information from the different drivers tend to reach the ear of the listener at different times and cause blurring or incoherence of the sound as heard by the listener.
Figure 3:
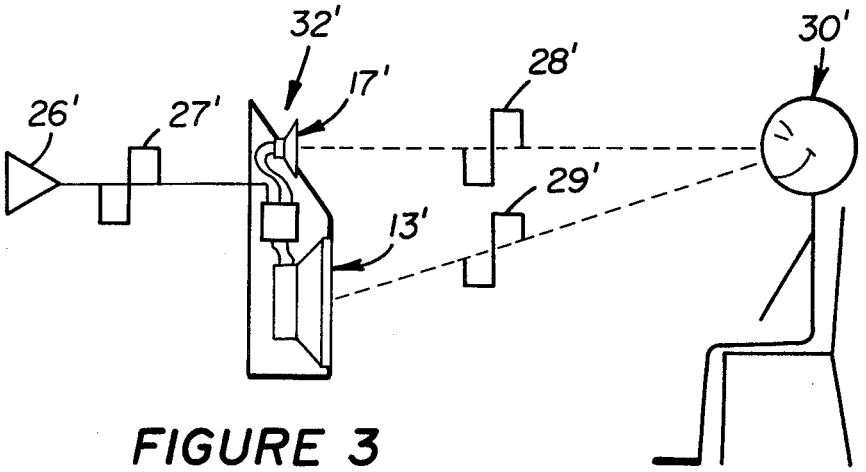
FIG. 3 is a view similar to FIG. 2 with the drivers of the speaker system being illustrated in alignment for achieving maximum sound coherency at a critical listening point occupied by a listener.
Figure 4:
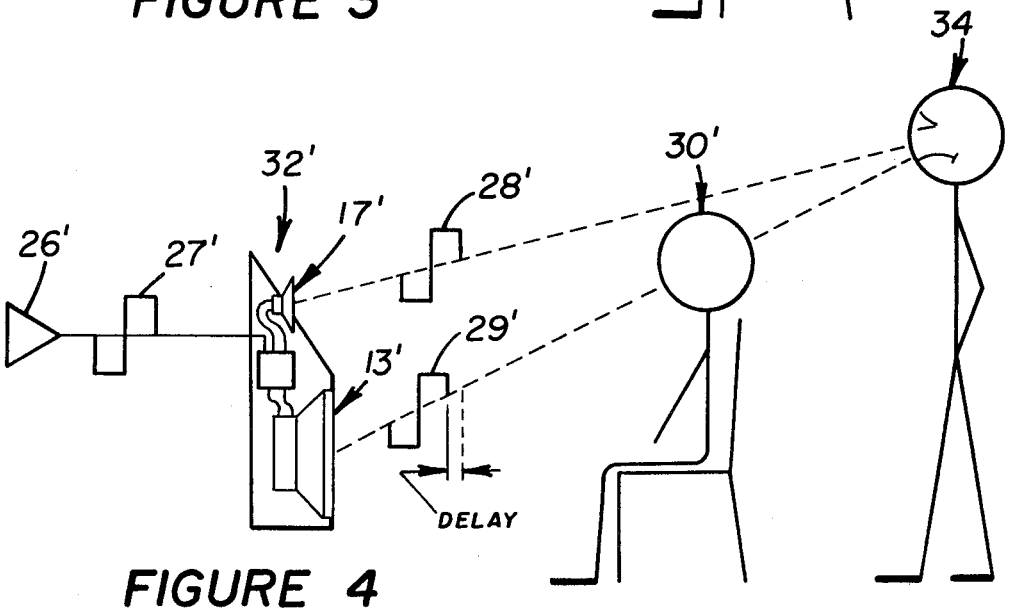
FIG. 4 is yet another view similar to that of FIG. 3, illustrating inability of a system of the prior art to accomodate a different critical listening point relative to the speaker system.

In this connection, reference is made to FIGS. 2–4 which illustrate various selected listening points and environments. The locale for the speaker assembly is generally indicated at 32 in each of FIGS. 2–4. A first critical listening point is indicated in each of the three figures at 30 while a second selected critical listening point is indicated at 34 in FIG. 4.

The manner of adjustment for the drivers in the speaker assembly to achieve maximum sound coherency is described in greater detail below in connection with FIGS. 2–4. It is initially noted, however, that while at least some of the drivers in the speaker assembly of FIG. 1 are adjustable fore and aft relative to the critical listening point, the present invention contemplates adjustment of the drivers along any axis relative either to each other or to a critical listening point in order to achieve a desired time or phase alignment. It is also noted that while in the speaker assembly of FIG. 1, and as described in the preferred embodiment of the invention, the adjustment apparatus for the drivers is calibrated in order to provide benefits such as those described above, the present invention contemplates any adjustment means for the drivers whether or not such means are calibrated. Referring to FIG. 1, it is noted that where rods are used to support and adjust a driver, such as the tweeter 17, one rod may be calibrated, as rod 22, while the second, as rod 24, need not be calibrated.

Figure 5:
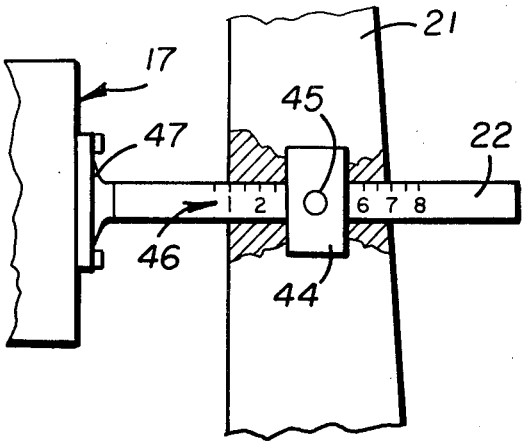
FIG. 5 is a fragmentary view, with parts in section, from the speaker system of FIG. 1 illustrating adjustment means for positioning a selected driver relative to the critical listening point and means for locking the driver in that position while providing a calibrated reading of the driver position.

Referring to FIG. 5, it may be seen that the driver housing is rigidly affixed to an elongated rod 22 via a mounting such as 47. The rod is slidably mounted through a hole in a mounting block 44, which is in turn rigidly mounted as part of the mounting sub-assembly 21. The calibration markings are generally indicated at 46, and may be indexed, for example, to the face of the mounting block 44. Means for locking the rod in position are provided by a set screw, indicated at 45.

Figure 6:
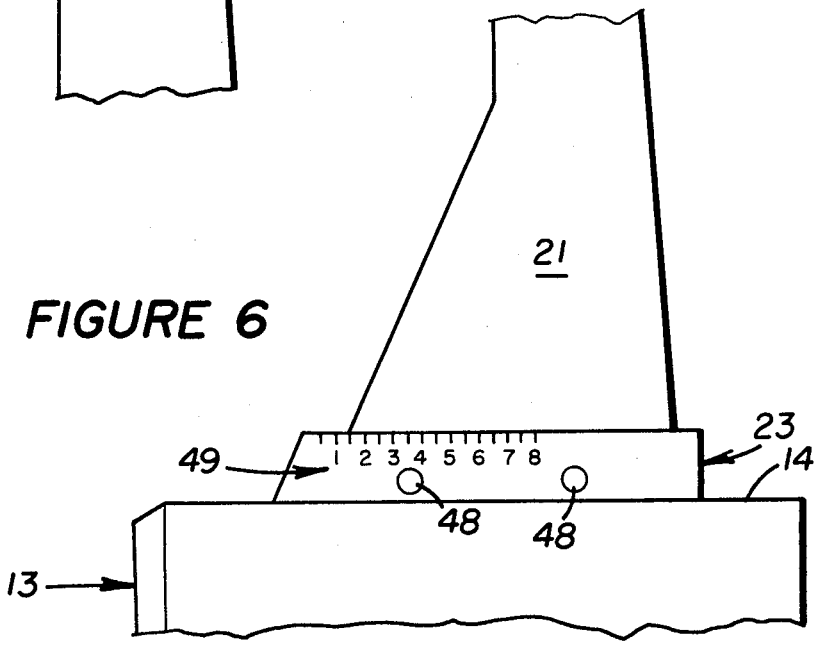
FIG. 6 is another fragmentary view from the speaker system of FIG. 1 illustrating adjustment and calibration means for a selected driver, or driver assembly, relative to the other drivers within the system while said driver(s) may remain fixed in relation to the critical listening point or to the listening environment. This may be accomplished by adjusting the position of a mounting sub-assembly which supports the other drivers relative to the "fixed" component.

Referring to FIG. 6, the position of the woofer 13 relative to the other drivers in the system is adjusted by sliding the mounting sub-assembly 21 along a calibrated track 23 which is in turn rigidly affixed to the woofer housing 14. The calibration markings are generally indicated at 49, and may be indexed, for example, to the front edge of the mounting sub-assembly 21. Locking bolts, indicated at 48, are provided to lock the assembly 21 in place.

Referring now to FIGS. 2–4, and particularly to FIG. 2, which is representative of the prior art, the low frequency range unit 13 and the high frequency range unit 17 are arranged in a co-planar relationship. An electrical sound signal in the form of a square wave as generally indicated at 27 is applied to the drivers 13 and 17 from a suitable source 26 through a crossover network 25. Without further consideration of factors present in the drivers and in the crossover network, it may be assumed for purposes of example that reproduced sound components 28 and 29 from the respective drivers 13 and 17 are slightly out of phase as they reach the listener, as represented by the delay component generally indicated at 33. Thus, the listener at critical listening point 30 would hear the reproduced sound components in a distorted blur, without the time domain coherence contemplated by the present invention.

Referring now to FIG. 3, a similar situation to that of FIG. 2 is represented. However, in this case the drivers 13 and 17 are positioned with a tweeter 17 somewhat behind the woofer 13, as is generally contemplated in the above cited Dahlquist patent. It may be seen that the delay between the sound components 28 and 29 as heard by listener at critical listening point 30 has been eliminated, rendering a coherent sound. It should be noted that the speaker system 32 of FIG. 3 is capable of producing coherent sound for only one critical listening point, and that said point will be at a fixed distance from the speaker system.

Referring now to FIG. 4, the same speaker system from FIG. 3 is indicated at 32. In this case it may be seen that a second listener at critical listening point 34 would hear a delay, or incoherence, between reproduced sound components 28 and 29. Further adjustment of the speaker system would be necessary in order to provide sound coherency at the critical listening point 34. This illustrates the need for apparatus and means to provide maximum sound coherence at a variety of given critical listening points.

Figure 7:
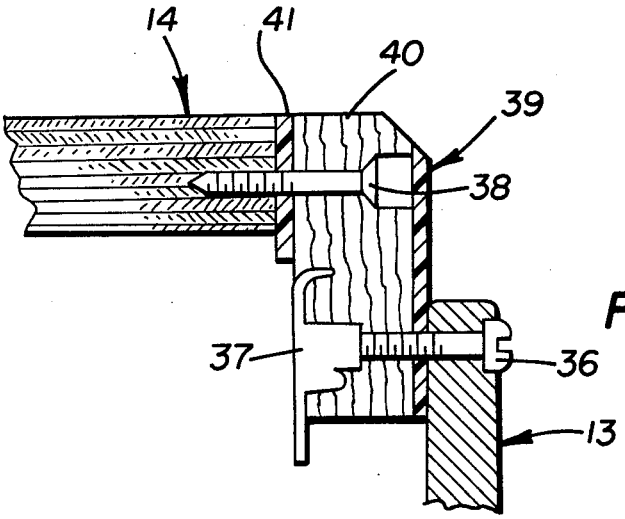
FIG. 7 is a fragmentary view, with parts in section, illustrating a sound isolating arrangement for mounting the woofer driver(s) to the low frequency housing.
Figure 9:
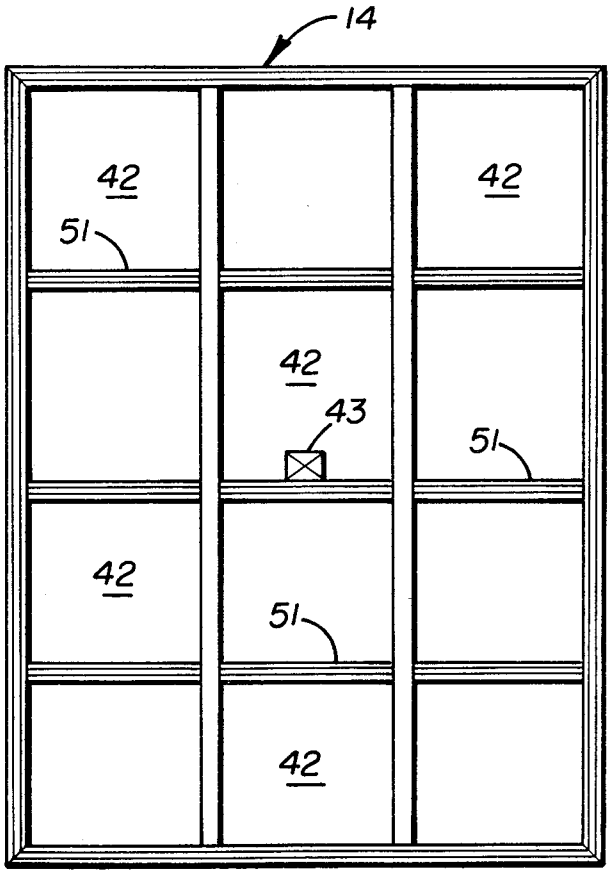
FIG. 9 is a view taken along section line IX—IX of FIG. 8.
Figure 8:
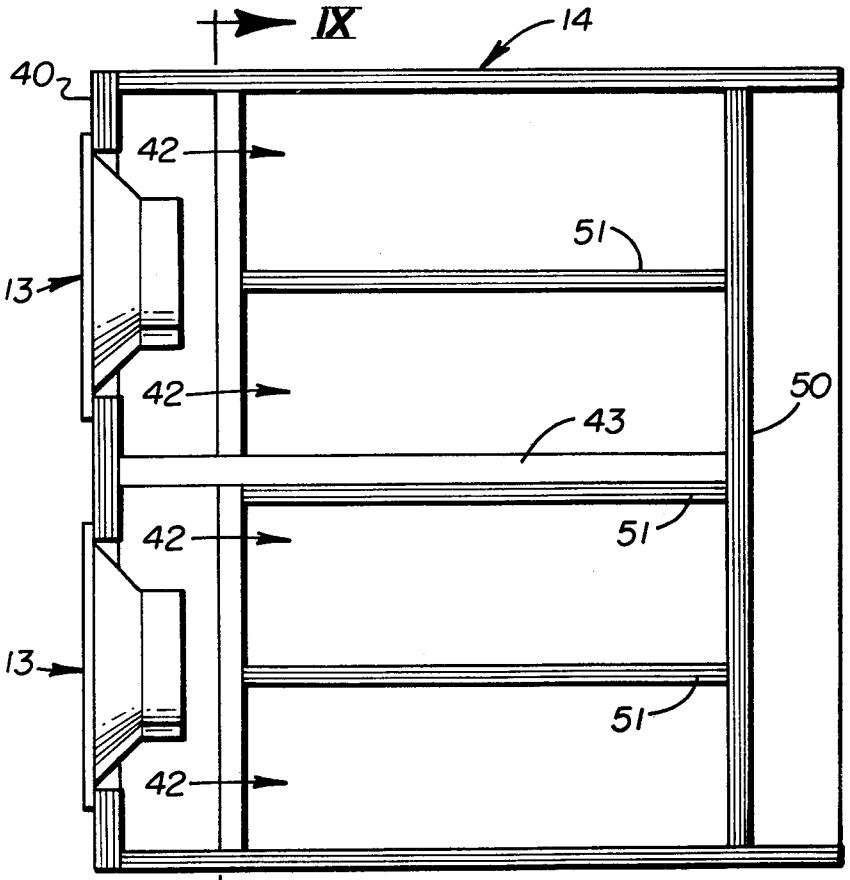
FIG. 8 is a side view with parts in section of the housing for the woofer(s) referred to above in FIG. 7.

Reference is now made to FIGS. 7–9 in order to disclose preferred construction details for the woofer housing 14. Generally, the woofer(s) 13 are mounted on a front panel of a woofer housing as illustrated for example at 40 in FIGS. 7 and 8.

Referring particularly to FIG. 7, the woofer unit fragmentarily represented at 13 is secured to the front panel 40 by one or more mounting screws such as indicated at 36. Sound absorbing material is arranged between the front panel 40 and the woofer unit 13 as well as between the front panel 40 and the remainder of the woofer housing 14 in order to isolate the woofer housing 14 from mechanical vibrations induced by the frame of the woofer unit 13, thus significantly reducing unwanted acoustical radiation from the housing 14 itself. The front panel 40 may, for example, be formed from a rigid material such as plywood. The sound absorbing means contemplated by the present invention comprises a sandwich panel arranged on the forward surface of the front panel 40 adjacent to the housing 14 as indicated at 41. Both of the sandwich panels 39 and 41 are of known construction which is not shown in greater detail herein. However, it is noted that each of the panels is of a laminate construction employing special sound absorbing plastics, and may include layers of metal plate.

The effect of this use of the sound absorbing layers as illustrated in FIG. 7, is to prevent the mechanical transmission of vibrations from the woofer frame 13 to the front panel 40, as well as from the front panel 40 to the woofer housing 14. Thus, there may be a significant reduction of structural vibration within the housing and a significant reduction of their accompanying re-radiation to the air, while at the same time maintaining the woofer unit(s) in rigid relation to the other drivers within the system in order to maintain maximum sound coherency.

It should be noted at this point that, in the prior art, woofer units have some times been isolated from their housings by, for example, soft rubber bushings which, although perhaps effectively achieving mechanical isolation, may not be able to maintain the woofer in rigid relation to the other drivers of the system and thus not be able to maintain maximum sound coherency as contemplated by the present invention.

In any event, the front panel 40 is secured to the woofer housing 14 by one or more screws 38 passing through the front panel and the sandwich plate 41. The screws 36 are similarly passed through the woofer frame 13, the sandwich plate 39, the front panel 40, and are engaged by the nuts such as that indicated at 37. It may be seen that the nuts 37 are also isolated from both the woofer frame 13 and the sandwich plate 41 in order to further prevent sound transmission from the woofer 13 to the housing 14.

Referring also to FIGS. 8 and 9, the woofer housing 14 is preferably constructed to achieve enhanced rigidity of the housing as well as damping of sound waves and reduction of non-linear air flow or turbulance within the housing. Since the low frequency range units of many speaker systems may generate considerably more mechanical energy and movement of air than other drivers in the system, the proper damping, or control, of these components is important if accurate, coherent sound is to be reproduced by the system.

For this purpose, a plurality of angled dividers 51 is arranged in spaced apart relation within the housing 14 to form sound wells extending rearwardly from the woofer driver(s) 13 in parallel relation with its axis. The dividers 51 are mechanically interconnected with each other and the inside surfaces of the housing 14, for example, by glue and "tongue-in-groove" construction, so that the sides of the housing are rigidly braced and the sound wells are separated from each other. The sound wells 42 all open forwardly toward the woofer(s) 13 and are individually filled with sound damping material such as, for example, fiber batting sold for example under the trademark Dacron. Thus, as sound waves propagate rearwardly from the driver(s), they pass into the separate sound wells 42 which prevent lateral turbulence effects from developing within the woofer housing 14. A brace element 43 also extends from the rear surface 50 to a central position on the front panel 40 in order to further stabilize the front panel and rigidify the entire housing 14.

Referring momentarily to FIG. 8, it may be seen that the rear surface 50 for the sound wells 42 could also form the back of the housing 14. However, the surface 50 is preferably spaced apart from the back of the woofer housing in order to form a space that may be used for further damping of sound waves or perhaps, for example, for storage or other purposes.

DESCRIPTION OF THE METHOD OF OPERATION

While it is believed that the method of operation contemplated by the present invention, for the adjustment of drivers relative to a critical listening point in order to establish maximum sound coherency at that point, is apparent from the above description, that method is described below in order to facilitate a more complete understanding of the invention.

In general, it may be desirable for reasons such as apparent image size to mount the drivers in a relatively spaced-apart configuration. It then becomes particularly desirable to establish a proper relation between the drivers and the critical listening point in order to achieve coherent sound reproduction at that point. Thus, while the present invention contemplates in general any adjustment of drivers along any axis within a speaker system, the invention particularly contemplates adjustment fore and aft of selected drivers within the speaker system illustrated in FIG. 1, assuming that the spaced-apart relation of the drivers has been predetermined in order to achieve various desired sonic characteristics. It should be noted that the method described below would serve equally well for adjustment of drivers along any axis in order to obtain maximum coherency of sound at a given desired point.

The pulse or phase response characteristics for any of a variety of drivers may be calculated or experimentally determined in a known manner. However, the present invention contemplates a method for adjusting the positions of drivers within a system relative to a critical listening point in order to compensate for the rise time characteristics of the drivers themselves, and also for effects that may be caused by associated equipment in the entire sound reproduction system.

With the speaker system 11 established at a predetermined locale within a selected listening environment, one or more critical listening points are also determined within the environment. In order to accurately monitor the emanations of the various drivers, a monitor such as a microphone or the like is mounted at one of the critical listening points, and coupled to a time domain measurement device such as an oscilloscope (not shown).

The woofer unit 13, being fixed in relation to the critical listening point, is used to establish a reference time delay component between the speaker system and the critical listening point. A sharp pulse is applied to the woofer unit via all, or a significant portion of, the sound reproducing system. The time elapsed from the generation of the electrical pulse and the arrival of its leading edge is then noted. The same pulse is then applied in turn to each of the remaining driver assemblies 15, 17, and 19 in turn. The position of each driver is then adjusted so that the leading edge of its reproduced pulse arrives at the critical listening point at the same time as the previously determined reference pulse. Thus, all the drivers may be adjusted so that their reproduced sound components will come into synchronization for a listener at that critical listening point.

The position of each driver assembly may now be noted using the calibration systems illustrated in FIGS. 5 and 6. The relation between the drivers may now be recorded in connection with the first critical listening point. This process of adjustment, calibration, and recording may be repeated for each of any additional critical listening points.

It is apparent that all or part of the speaker system 11 could be disassembled and reassembled with the proper relation between the drivers being reproduced without repeating the monitoring steps described above. At the same time, the speaker system could easily and repeatedly be adjusted to produce maximum sound coherency at any of the previously determined critical listening points, by simply referring to the calibrations recorded for those points as described above.

It is also apparent that interchangeable driver components for a speaker system could be designed with precalibrated positions, in order to facilitate their interchange into a previously adjusted speaker system while substantially maintaining maximum sound coherence as described above.

Various other modification and changes will be readily apparent within the scope of the present invention in accordance with the method and apparatus described above. Many variations upon the mounting sub-assembly are possible beyond that illustrated in FIG. 1. For example, components could be ceiling mounted, or mounted with a motor drive to facilitate automatic adjustment of their relative positions. While the preferred embodiment of the present invention includes calibration means for reasons described above, any means for adjustment of drivers, with or without calibrations, according to the method described above would fall within the scope of the invention. Accordingly, the scope of the present invention is defined only by the following claims.

What is claimed is:

1. In a speaker assembly including a plurality of drivers, the improvement comprising mounting means for independently supporting the plurality of drivers, the mounting means for at least selected drivers of the plurality of drivers including means for independently adjusting the respective selected drivers relative to a critical listening point in a listening environment in order to establish increased sound coherency for the plurality of drivers at the critical listening point of the listening environment by establishing a desired time or phase alignment for the drivers, the adjustment means including calibration means allowing repeatable alignment of drivers within the system relative either to each other or to one or more critical listening points within a listening environment in order to establish a desired time or phase alignment, and which means facilitates the interchange of drivers within the speaker system while maintaining said desired time or phase relationship.

2. The speaker assembly of claim 1 further comprising a relatively massive, low frequency range driver supported in fixed relation on the mounting means, the selected drivers comprising a plurality of relatively higher frequency range drivers.

3. The speaker assembly of claim 1 wherein the respective drivers are mounted in spaced-apart relation from each other.

4. The speaker assembly of claim 1 wherein the low frequency driver is mounted on a front panel of a rigid housing, the front panel being isolated from the housing by sound absorbing means and having sound absorbing means arranged on its outer surface about the low frequency driver to limit lateral sound propagation from the low frequency driver.

5. The speaker assembly of claim 4 wherein an interior portion of the rigid housing behind the low frequency driver is divided into a series of independent sound wells extending parallel to the axis of the low frequency driver, the sound wells opening toward the low frequency driver and extending to a rear surface of the housing in order to achieve damping of sound within the housing behind the low frequency driver.

6. The speaker assembly of claim 5 wherein the sound wells are formed by dividers interconnected with each other and with the rear surface of the housing.

7. The speaker assembly of claim 1 wherein the respective drivers are mounted in relatively spaced-apart relation, the adjusting means comprising elongated rod elements along which the respective drivers are movable and means for locking the respective drivers in adjusted positions on the elongated rod elements.

8. A speaker assembly comprising a low frequency driver mounted on a front panel of a rigid housing including outer walls, the front panel being isolated from the housing by sound absorbing means and having sound absorbing means arranged on its outer surface about the low frequency driver to limit lateral sound propagation from the low frequency driver to the walls of the housing, an interior portion of the rigid housing behind the low frequency driver being divided into a series of independent sound wells extending parallel to the axis of the low frequency driver, the sound wells opening toward the low frequency driver and extending generally from the low frequency driver to a rear surface of the housing in order to damp sound within the housing behind the low frequency driver, the sound wells being formed by dividers interconnected with each other and with the rear surface and side surfaces of the housing.

9. In a method for mounting a plurality of drivers of a speaker assembly within a selected listening environment for producing highly coherent sound at a critical listening point, the steps comprising independently supporting the plurality of drivers at the predetermined locale with at least selected drivers of the plurality being adjustable generally fore and aft relative to the critical point, placing sound monitoring means at the critical listening point and adjusting the respective selected drivers according to the monitoring means for establishing maximum sound coherency for the plurality of speakers at the critical listening point of the listening environment, the selected drivers being mounted on elongated rod elements along which the respective drivers are movable and further comprising means for locking the respective drivers in adjusted positions on the elongated rod elements.

10. The method of claim 9 further comprising calibration means for determining the relative positions of the drivers when adjusted for maximum sound coherency.

11. The method of claim 10 wherein different drivers are adapted for interchangeability at the predetermined locale with predetermined calibration positions for substantially maximum predetermined sound coherency at the critical listening point of the listening environment.

12. In a method for mounting a plurality of drivers of a speaker assembly within a selected listening environment for producing highly coherent sound at a critical listening point, the steps comprising independently supporting the plurality of drivers at the predetermined locale with at least selected drivers of the plurality being adjustable generally fore and aft relative to the critical point, placing sound monitoring means at the critical listening point and adjusting the respective selected drivers according to the monitoring means for establishing maximum sound coherency for the plurality of speakers at the critical listening point of the listening environment, calibration means being employed for determining the relative positions of the drivers when adjusted for maximum sound coherency.

* * * * *